United States Patent [19]

Fowler

[11] 4,371,984

[45] Feb. 8, 1983

[54] PALM GUARD

[76] Inventor: Gary P. Fowler, Tennant Star Rte., Box 93, Macdoel, Calif. 96058

[21] Appl. No.: 258,411

[22] Filed: Apr. 28, 1981

[51] Int. Cl.[3] ..... A41B 13/00

[52] U.S. Cl. ..... 2/20

[58] Field of Search ..... 2/20, 16; 294/25

[56] References Cited

U.S. PATENT DOCUMENTS 690,302 12/1901 Lee ..... 2/20

1,377,103 5/1921 Suhr ..... 2/20

1,919,084 8/1933 Wyant ..... 2/20

*Primary Examiner*—Doris L. Troutman

*Attorney, Agent, or Firm*—Lewis B. Sternfels

[57] ABSTRACT

A palm guard (20, 40, 60) for use in manually inserting a stay (16) into the ground (12) for securing a resin tube (14) about a tree (10) in reforestation projects comprising a base (22, 42, 62) attachable to a user's hand (17), and a rim (24, 44, and 64) attached to the base and forming a pocket (37, 57, 77) for receiving the end of the stay.

7 Claims, 6 Drawing Figures

PALM GUARD

TECHNICAL FIELD

The present invention relates to a palm guard which is useful for manually inserting a stake into the ground.

BACKGROUND ART

While the present invention has been designed primarily for use in securing protective tubular screens about trees for reforestation purposes, called "tubing" in the art, it is to be understood that such a specific use is only illustrative of the general field of similar applicability. However, because the genesis of the present invention is for use with reforestation projects, the following exposition will rely thereon.

Care must be exercised in the planting of young trees or seedlings with regard to replanting of forest areas. Specifically, animals, in particular deer, injure and kill such young trees or seedlings. It is, therefore, necessary to protect them, and the usual manner is to place a seamless tube of resin mesh about the seedlings. To insure that the tubes remain in position, two metal stays or stakes are inserted through the lower portions of each tube diametrically opposite from one another, and each is driven into the ground. Such an operation is manually performed. To facilitate insertion of the stays in the mesh, they are provided with an undulated screwlike configuration so that they can be woven through the lower mesh portion of the tube. Tubes thus prepared with the stays woven in position are then inserted over the tree, and the stays are pushed or thrust down into the ground by the palm of the inserter's hand. To protect the palm from injury, all manner of protection has been used, including gloves, leather wrapped with tape, rocks, and even bottle caps, which are wrapped into the palm of the hand. Thus, the hand is protected from the metal stays and their twisting or rotating movement as they are inserted into the ground. Such movement quickly wears a hole through the protection; for example, two days through a relatively hard rock.

Using the above protective devices, an average worker could plant approximately 50 to 80 trees per hour, the variation depending upon the particular individual, how hard that individual worked, and the particular manner of hand protection used.

SUMMARY OF THE INVENTION

The present invention overcomes and avoids these and other problems by utilizing a special palm guard which is adapted to be held by or attached to the user's hand and which provides a pocket or recess for receiving an end of the stake or stay.

Several advantages accrue from the use of the inventive palm guard. Most importantly, it is specifically designed to resist the twisting and digging action of the stay as it is driven into the ground. It provides for increased safety to the user by protecting against accidental slippage of the stake during its insertion into the ground and, in general, by protecting the user's hand from localized forces exerted by the stake on the hand. Associated with safety is increased comfort to the hand. With respect to the specific art of placing tubes about trees, all users found that they could tube faster than previously. Before use of the invention, as noted above, approximately 50 to 80 trees per hour could be tubed, but with the invention, this rate was increased to approximately 125 to 190 trees per hour, also again depending on the particular person utilizing the invention.

Other aims and advantages, as well as a more complete understanding of the present invention, will appear from the following explanation of exemplary embodiments and the accompanying drawings thereof.

DETAILED DESCRIPTION OF THE INVENTION

Figure 1:
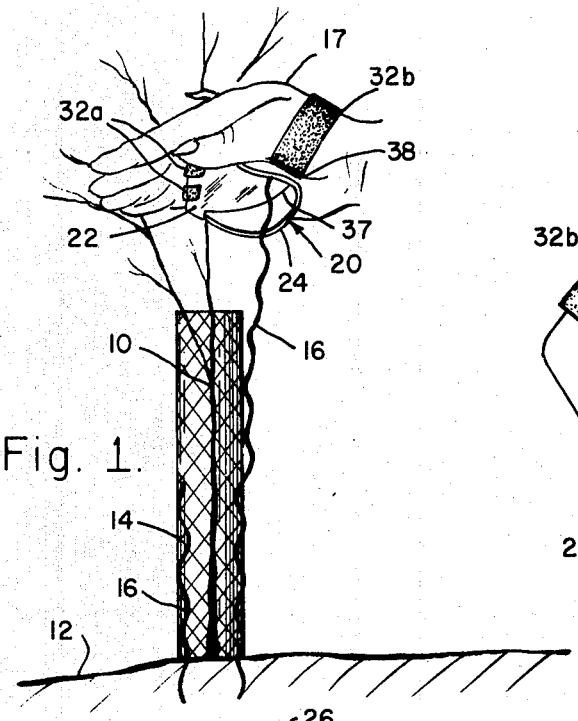
FIG. 1 is a view of a protective tube placed over and about a newly planted tree, with one stay already affixing the tube in the ground and with the second stay positioned in readiness to be similarly affixed by use of the present invention shown secured to a user's hand.

In FIG. 1, a newly planted tree 10 is shown in position in the ground, denoted by indicium 12. To protect the tree against animals, a tube 14 is placed around the tree. The tube preferably is of seamless mesh of a resinous material which is constructed to disintegrate within approximately three years. Typically, the mesh is formed of resinous material approximately ⅛ inch thick and ½ inch square to provide a diamond configuration. To secure the tube to the ground and about the tree, a pair of stakes or metal stays 16 are woven through the lower third of the tube, then the tube with stays is inserted over the tree and the stays are thrust down into the ground by the user's palm of his hand 17. Typically, both the tube and the stays are one foot long. The stays are driven approximately 3 inches to 4 inches into the ground.

Figure 2:
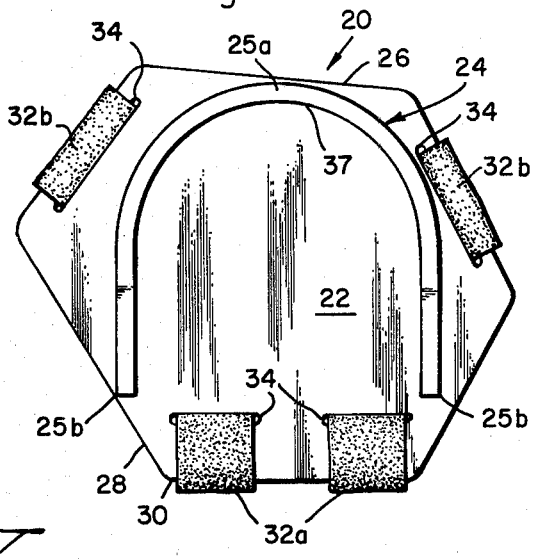
FIG. 2 is a front elevational view of a preferred embodiment of the invention of the type used in FIG. 1.
Figure 3:
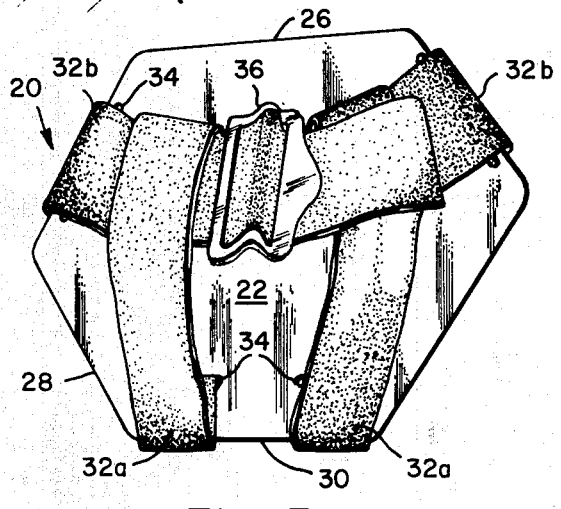
FIG. 3 is a rear elevational view of the embodiment of FIG. 2.
Figure 4:
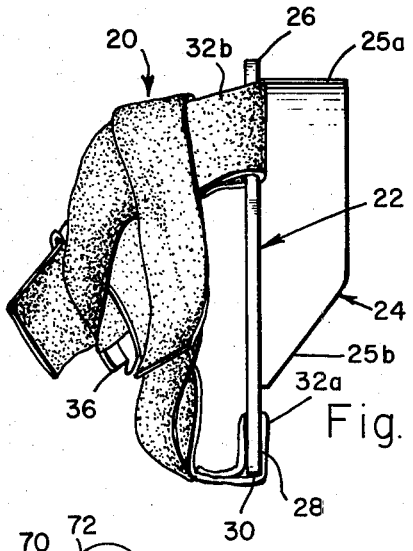
FIG. 4 is a side elevational view of the embodiment of FIG. 1.

In order to drive the stays into the ground, one of several types of palm guards may be used, of which three are illustrated in FIGS. 2–6. In FIGS. 2–4, a palm guard 20 comprises a base 22 to which a curved rim 24 is secured with the closed part 25*a* of the rim being positioned adjacent the rearward portion 26 of the base generally towards the wrist of the user. The rim opens at ends 25*b* at the other end of the base, which narrows down into a neck portion 28 which terminates at an end 30, positionable at the wearer's fingers. Attached to end 30 and on either side of base rearward portion 26 are straps or webbing 32*a* and 32*b* which extend through slots 34 in base 22. Webbing 32*a* is adapted to be positioned on either side of the wearer's middle finger. The straps extend towards the back of the wearer's hand and are buckled together by buckles 36. When the palm guard 20 is placed in the user's hand as shown in FIG. 1, rim 24 will face outwardly fromm the palm of the user in readiness for receipt of the stake or stay in a pocket or recess 37, formed by the mating connection between rim 24 and base 22. Also as seen in FIG. 1, the thumb muscle 38 tends to abut against base rearward portion 26 to aid in control of the palm guard.

Figure 5:
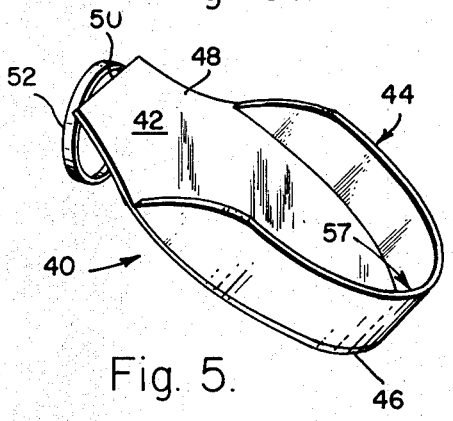
FIGS. 5 and 6 are perspective views of second and third embodiments of the present invention.

In FIG. 5, a second embodiment 40 of the palm guard has the same general appearance as palm guard 20 depicted in FIGS. 2–4 and comprises a base 42, a curved rim 44 attached to the base, a first end 46 adapted to be positioned adjacent the wearer's wrist or thumb muscle, a neck portion 48 at its other end, and a terminating surface 50 which is adapted to be positioned adjacent the user's fingers. In this embodiment, a circular piece 52 is attached to neck 48 and extends in a direction which is opposite from the direction in which rim 44 extends. The user's middle finger is adapted to extend through circular piece 52.

Figure 6:
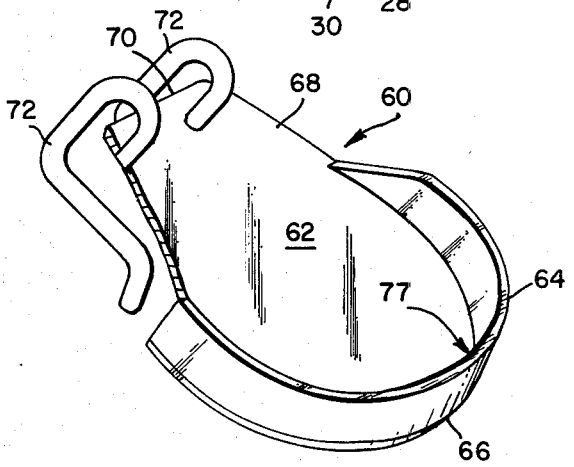

A third embodiment 60, depicted in FIG. 6, likewise comprises a base 62, a rim 64 attached thereto, an end portion 66, a forward necked-down portion 68, and an end portion 70. In this embodiment, the means by which palm guard 62 is attached to the hand is by a pair of rods 72 which extend from neck 68 and curve out and around edge 70 in a direction opposite to that of rim 64. The rods are placeable on either side of the middle finger.

In addition to the curvature of rims 24, 44 and64, bases 22, 42 and 62 may also be curved to help direct the travel of the stake to the rear portion into recesses 37, 57 and 77 for most efficient driving of the stakes into the ground. In addition, end portions 26, 46 and 66 are adjacent the thumb muscle of the hand, as best shown in FIG. 1. Thus, while some force in driving the stake into the ground is distributed between the fingers, the flat of the hand exerts the primary force, with the thumb muscle lending aid and stability.

Although the invention has been described with reference to particular embodiments thereof, it should be realized that various changes and modifications may be made therein without departing from the spirit and scope of the invention.

I claim:

1. A palm guard for use in manually inserting a stake in the ground comprising a base, means for enabling said base to be held by a user's hand, and a rim secured to said base and forming therewith a pocket for receiving an end of the stake.

2. A plam guard according to claim 1 in which said enabling means comprises straps coupled to said base and adapted to be extended through the fingers and at the back of the wearer's hand.

3. A palm guard according to claim 1 in which said enabling means comprises a ring coupled to said base for extension therethrough of a wearer's finger.

4. A palm according to claim 1 in which said enabling means comprises rods coupled to and extending from said base and adapted to be extended throuth fingers of the wearer's hand.

5. A palm guard according to any of claims 1–4 in which said enabling means includes a portion at an edge of said base adjacent to said rim for contact with the thumb muscle of the wearer's hand.

6. A palm guard according to claim 1 in which said rim is curved to direct the stake to a rearward portion of said base, adjacent the thumb muscle of the wearer's hand.

7. A palm guard according to claim 6 in which said base is curved to direct the stake to said rearward portion of said base.

* * * * *